US012590260B2

(12) United States Patent
Hillmann

(10) Patent No.: US 12,590,260 B2
(45) Date of Patent: Mar. 31, 2026

(54) BIOMASS PROCESSING

(71) Applicant: Drax Biomass, Inc., Monroe, LA (US)

(72) Inventor: Ricardo Hillmann, Monroe, LA (US)

(73) Assignee: Drax Biomass, Inc., Monroe, LA (US)

( * ) Notice: Subject to any disclaimer, the term of this patent is extended or adjusted under 35 U.S.C. 154(b) by 140 days.

(21) Appl. No.: 18/444,706

(22) Filed: Feb. 18, 2024

(65) Prior Publication Data

US 2025/0263617 A1 Aug. 21, 2025

(51) Int. Cl.
*C10L 5/44* (2006.01)

(52) U.S. Cl.
CPC ..... *C10L 5/442* (2013.01); *C10L 2200/0469* (2013.01); *C10L 2290/08* (2013.01); *C10L 2290/28* (2013.01)

(58) Field of Classification Search
CPC ..... C10L 5/442; C10L 2200/0469; C10L 2290/08; C10L 2290/28
See application file for complete search history.

(56) References Cited

U.S. PATENT DOCUMENTS

2014/0259895 A1* 9/2014 Mason ..... B30B 11/006 44/589

FOREIGN PATENT DOCUMENTS

IT PD20100103 A1 * 10/2011

OTHER PUBLICATIONS

ITPD20100103A1 Translation Claims (Year: 2011).*
ITPD20100103A1 Translation Describtion (Year: 2011).*
International Search Report and Written Opinion for corresponding International Application No. PCT/US2025/016209, issued May 28, 2025.
Wurm Andreas: "Diesen Weg nehmen Pellets bei ihrer Herstellung", 2 Aug. 5, 2021 (Aug. 5, 2021), pp. 1-11, XP093276917, Retrieved from the Internet: URL:https://web.archive.org/web/20210805084813/https:// www.dein-heizungsbauer.de/ratgeber/bauen-sanieren/pelletsherstellung/#c7860.

* cited by examiner

*Primary Examiner* — Ellen M McAvoy
*Assistant Examiner* — Chantel Graham
(74) *Attorney, Agent, or Firm* — Renner, Otto, Boisselle & Sklar, LLP

(57) ABSTRACT

A method and apparatus are provided for producing biomass pellets. Biomass pieces are received in a sizing stage and the biomass pieces are processed in the sizing stage to reduce their average size. Moisture is driven off moisture from the biomass in a drying stage. The biomass is compressed to form pellets in a pelletizing stage. After the drying stage, there is no further active reduction in the average size of the biomass pieces.

11 Claims, 2 Drawing Sheets

BIOMASS PROCESSING

The present invention relates to a biomass processing method and an apparatus for processing biomass, wherein the biomass is converted into pellets.

The pellet industry supplying fuel for large power generation units uses raw materials that is a mix of wood matter varying in size from chips to saw-dust. For those materials, the incoming moisture content is also ranging widely. The described raw material is a non-usable sub product from forestry operations and other wood manufacturing operations like sawmills. In all cases the wood supplied to the plants has to be free of chemical products (Urban wood waste as an example is not an option to use given potential chemical products embedded in the wood)

The traditional process includes a primary size reduction to break down the larger size fractions (chips as an example) prior to drying and a secondary Sizing process after the material is dried out.

In the wood processing industry that requires fibre to be separated and reduced in size it is a vast number of units or equipment that can achieve the size reduction Objective. In our case the pellet industry has evolved in the last couple of decades, referring to Industrial facilities that can produce 200,000 Metric Tons/Year or more and excluding the smaller operations that are focused on different markets not as sensitive to aspects like particle size distribution internal to the pellets or over all moisture content. Small plants are normally inconsistent and not comparable to what our large scale and sophistication requires.

The larger plants have developed designs around the concept of receiving the raw material and because the generation of that raw material is to a large extend part under external vendors control, aspects like size distribution are variable and, in some cases, even over the larger allowable limit. For that reason, the first step in the current process is a primary size reduction in what is known as a Bio-Sizer or Green Hammer Mill. That process can be combined, or not, with a pre-screening that will do a selection of material by size before processing. Not all plants have screening, it is plant specific. If a screen is incorporated:

- The material that is already small enough will bypass this first size reduction and move on to the next step in the process.
- If it requires initial sizing will go to the Green Hammer Mill or Bio-sizer.
- In some cases, can also be an oversize protection that will reject the extreme large size product.

Traditional/current plants will take the combination of the wood after the Green Hammer Mill/Bio-Sizer and accepts from the Screening process and take it to the dryer to eliminate the undesirable moisture. Usually, this step reduces the moisture content from the maximum 100% in dry basis to approximately 10% dry basis. Those parameters fluctuate depending on raw material input and Final Product requirement.

With the previously considered process, the material going into the dryer has pieces that are significantly larger than others and the physical process of removing water from inside a small piece of wood versus a large piece of wood at the same drying temperature (that is the nature of wood dryers, all pieces are exposed to the same temperature), requires a different retention time in the dryer. The bigger the particle the longer it must be retained in the drier.

After the dryer the previously considered plant configuration has another step that again runs the product through a screen and what is small enough will pass through the next step, but what is still too large for pellet production will run through the Dry Hammermill Process. This process has the advantage that material being dry flows better through certain types of grinders and material being dry is prone to break apart (it becomes fragile once is dry). The material is fragile but is also hard to break from the energy consumption standpoint and for the same size reduction and all other conditions equivalent, the [Kw/hr. Per Ton] required to process dry material is higher than for wet material. The other aspect on this equipment is that the high energy consumption in conjunction with the dry fragile but strong product, generate tooling wear that is higher compared to the Green Hammermill Process (again assuming. equal size reduction/Ton bases.

The previously considered Hammermilling process also has problems. A typical requirement is that the lowest possible amount of material passes a 0.1 mm screen. This is a sieve testing conducted that establishes what that amount is as a percentage of the total. Dry Hammermills tend to produce this undesirable sized product given the fragility mentioned before and there is no way to eliminate or reduce that. Currently the practise is to screen free fines after pellets are produced and return them, to reintroduce them again on the product. This loop may be considered a waste of effort, (doing the same work twice). Typically, some of those fines are captured as fugitive dust from conveyor transitions and an attempt is again made to reintroduce them. This again represents a loss of energy and effort.

Embodiments of the present invention aim to provide a method and apparatus for producing biomass pellets in which the aforementioned problems are addressed.

The present invention is defined in the attached independent claims, to which reference should now be made. Further, preferred features may be found in the sub-claims appended thereto.

According to one aspect of the present invention, there is provided a method of producing biomass pellets, the method comprising the steps of receiving biomass pieces in a sizing stage, processing the biomass pieces in the sizing stage to reduce their average size, driving off moisture from the biomass in a drying stage, and compressing the biomass to form pellets in a pelletizing stage, wherein, after the drying stage, there is no further active reduction in the average size of the biomass pieces.

The sizing stage may comprise processing the biomass pieces by one or more of hammering, cutting, chopping and grinding.

The drying stage may comprise reducing the moisture content of the biomass, more preferably from as high as 120% in dry basis to as low as 3% in dry basis, or to a percentage in between.

The method may include at least one screening stage, in which the biomass pieces are separated according to size. In a preferred arrangement, the method includes at least two screening stages.

Preferably, the drying stage comprises exposing the biomass to gas flow, more preferably to air flow. The drying stage may comprise moving the biomass on a conveyor, such as a belt.

There may be a plurality of sizing stages, all of which take place prior to the drying stage.

In a preferred arrangement, the method comprises a first screening stage, followed by a first sizing stage, followed by a second screening stage, followed by a second sizing stage.

The method may comprise converting the sized, and then dried, biomass into pellets by pressing the biomass through a pelletizing die.

According to another aspect of the present invention, there is provided an apparatus for the production of biomass pellets, the apparatus comprising a sizing part, for reducing the average size of biomass pieces, a drying part, for drying the biomass, and a pelletizing part for compressing the biomass to form pellets, wherein, the apparatus is arranged so that after the drying stage, there is no further active reduction in the average size of the biomass pieces.

The sizing part may comprise one or more of a hammer, a cutter, a chopper and a grinder.

The drying part is preferably arranged to reduce the moisture content of the biomass from as high as 120% in dry basis to as low as 3% in dry basis, or to a percentage in between.

The apparatus may include at least one screening part, arranged to separate the biomass pieces according to size. In a preferred arrangement, the apparatus includes at least two screening parts.

Preferably, the drying part is arranged in use to expose the biomass to gas flow, more preferably to air flow. The drying part may comprise a conveyor, such as a belt.

There may be a plurality of sizing parts, all of which are arranged to reduce the size of the biomass pieces prior to the drying.

In a preferred arrangement, the apparatus comprises a first screening part, followed by a first sizing part, followed by a second screening part, followed by a second sizing part. The pelletizing part may comprise a pelletizing die.

The invention may include any combination of the features or limitations referred to herein, except such a combination of features as are mutually exclusive, or mutually inconsistent.

A preferred embodiment of the present invention will now be described, by way of example only, with reference to the accompanying diagrammatic drawings, in which:

DESCRIPTION OF THE DRAWINGS

Turning to FIG. 1, this shows schematically, generally at 1000, a previously considered process for the production of biomass pellets. The raw biomass arrives at an input stage 1100 and meets a first screen 1200. Pieces of biomass that already meet the size requirements for drying are separated and sent to a drier 1300. Pieces of biomass that are too big to be dried are then subjected to a first size reduction at sizing stage 1400, which typically comprises a green hammer mill stage.

After the drier 1300, the biomass pieces are subjected to a second screen 1500, in which the pieces that are already small enough to be pelletized are sent directly to a pelletizing stage 1600. The pieces that are not yet sufficiently small to be pelletized are sent to a second sizing stage 1700, which typically comprises a dry hammer mill. After the second sizing stage, the biomass is processed by the pelletizing stage 1600, typically by forcing the biomass material through a pelletizing die under great pressure. Biomass pellets are then output at stage 1800. Any fine material remaining after the pelletizing stage is returned to the input 1100.

Figure 1:
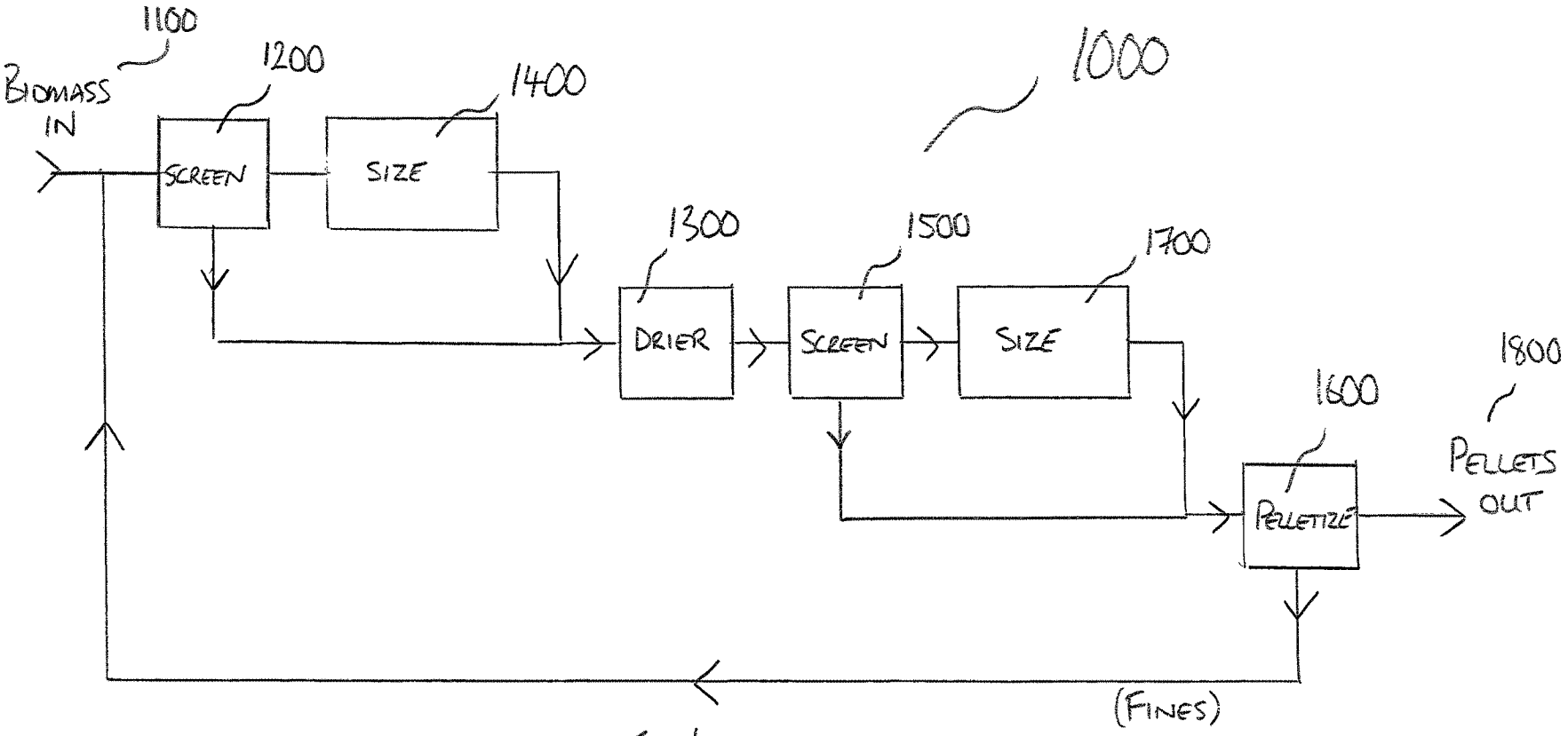
FIG 1 (PRIOR ART)
FIG. 1 shows schematically a process flow for a previously considered method of producing biomass pellets.
Figure 2:
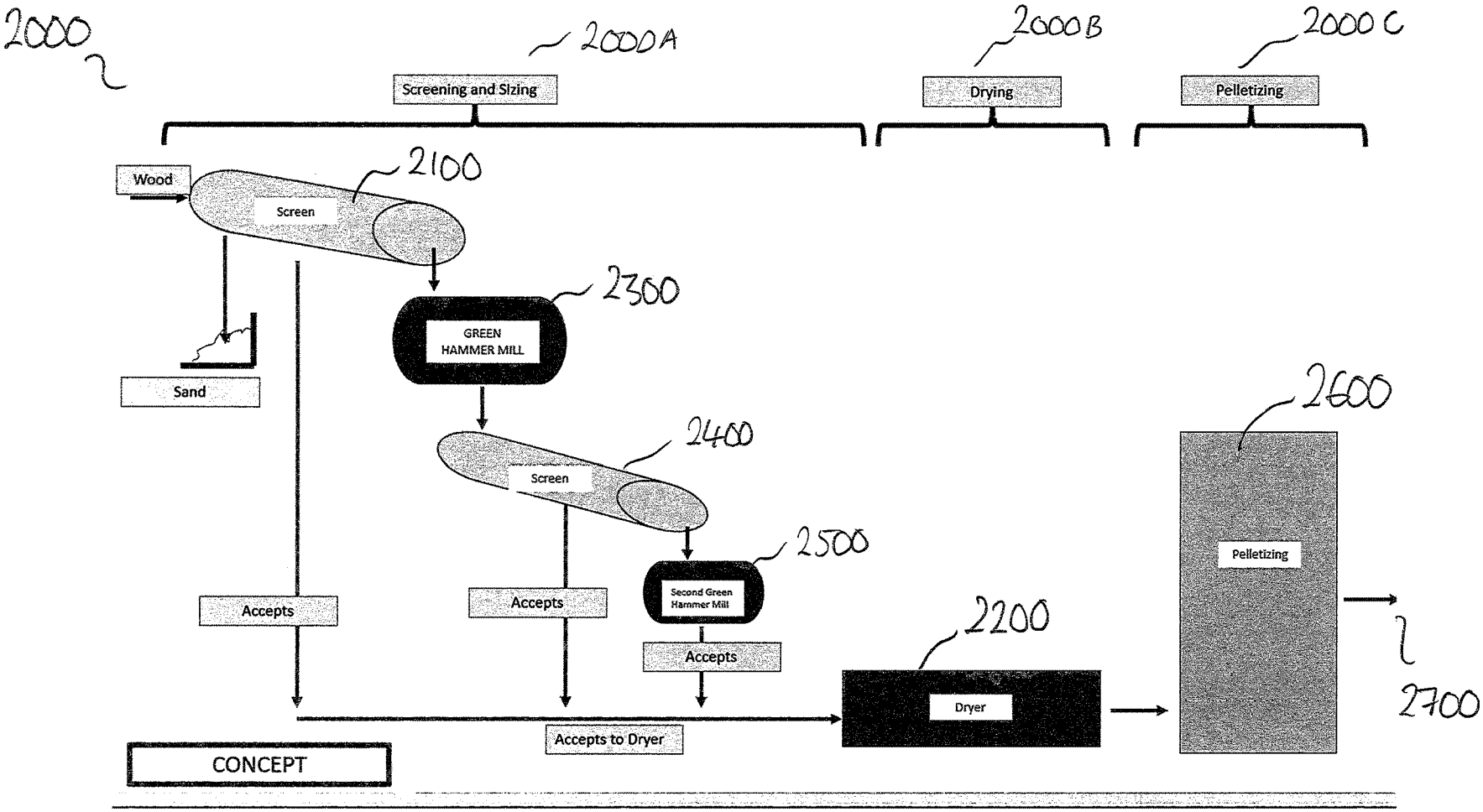
FIG. 2 shows schematically a process for producing biomass pellets according to an embodiment of the present invention.

FIG. 2 shows schematically, generally at 2000 a process for processing raw biomass material into biomass pellets according to an embodiment of the present invention.

The process is divided into three, distinct sequential phases: screening and sizing 2000A, drying 2000B and pelletizing 2000C.

At the screening and sizing stage 2000A, biomass (typically in the form of wood) is introduced to a first screening at 2100 where sand and other non-biomass particulates are removed. Pieces of biomass that are already sufficiently small to be dried are also separated out and sent directly to a drier 2200. Biomass pieces that are not screened out at 2100 are processed at a first sizing stage 2300, in this case in the form of a green hammer mill. The biomass exiting the first sizing stage are subjected to a second screening stage 2400 and, again, pieces that are sufficiently small are separated and sent to the drier 2200. Larger pieces are subjected to a second sizing stage 2500 and are then sent to the drier 2200.

The drier stage 2200 involves moving the size-reduced biomass particles on a moving belt and subjecting them to a current of drying air. All of the size reduction has been completed before the biomass enters the drying stage. Other drying equipment, including but not limited to a rotary drier, may be used for drying the biomass.

After exiting the drying stage 2200 the biomass is sent to a pelletizing stage 2600 in which the biomass is compressed and forced through a pelletizing die to form the pellets which are output at 2700.

Embodiments of the present invention provide a production method and/or apparatus in which all necessary size reduction takes place prior to the drying process and in which "dry sizing" is therefore eliminated. This has the advantageous effect of reducing the overall energy consumption of the process. In addition, the fire risk associated with dry sizing is eliminated and the overall plant configuration is simplified, with the consequent cost reduction.

The use of screening provides the possibility to also separate extreme final material that will serve as a cleaning mechanism to eliminate sand and fines contaminant as early as possible in the process.

Conducting all of the sizing (and screening) prior to the drying stage influences the size distribution of biomass pieces entering the drying stage, effectively preventing larger pieces from going into the dryer and creating a distribution in size which is biased towards the smaller pieces. This not only facilitates and makes the drying more homogeneous between pieces but also reduces the necessary retention time inside the dryer at the same temperature. This in turn allows for a reduction in the size of the dryer.

Another advantage is the ability to use a belt dryer. Rotary dryers are used in the previously considered systems because they are able to handle the drying of pieces of different sizes, given that they have an indirect way to have different retention times. This necessity reduces options for drying. In contrast, the inventive design allows for belts in place of rotary dryers which can work at lower temperatures, have fewer moving parts, smaller foundations, and require much less air flow.

Dry hammermilling is eliminated all completely and all the size reduction is handled in the first step, prior to drying. This first step may include grinding or sizing with a piece of equipment or combinations of pieces of equipment and optionally includes screening steps. All biomass pieces leave this processing step prior to the dryer at the correct size. This approach reduces the energy consumption per ton produced, eliminates the risk associated a with fire and explosions in the dry hammermilling process, reduces the overall tooling cost per ton produced and eliminates the requirement of gas treatment with the use of a Regenerative Thermal Oxidizer or Regenerative Catalytic Oxidizer (both are essentially ovens that burn natural gas to heat the air, at the cost of CO2 emissions but in compliance with environmental regulations in some territories).

The process is expected to reduce the generation of material fine enough to pass the 0.1 mm screen. This material is not beneficial to the process.

Embodiments of the present invention provide the further advantages of reducing maintenance cost on the plant and reducing the frequency with which tools and equipment must be replaced due to wear and erosion, since solids have been removed at an early stage.

Whilst endeavouring in the foregoing specification to draw attention to those features of the invention believed to be of particular importance, it should be understood that the applicant claims protection in respect of any patentable feature or combination of features referred to herein, and/or shown in the drawings, whether or not particular emphasis has been placed thereon.

The invention claimed is:

1. A method of producing biomass pellets, the method comprising the steps of receiving biomass pieces in a sizing stage, processing the biomass pieces in the sizing stage to reduce their average size, driving off moisture from the biomass in a drying stage, and compressing the biomass to form pellets in a pelletizing stage, wherein, after the drying stage, there is no further active reduction in the average size of the biomass pieces, wherein the sizing stage comprises two distinct sizing stages, and prior to a first one of the sizing stages, biomass is introduced to a first screening stage where sand and other non-biomass particulates are removed, pieces of biomass that are already sufficiently small to be dried are also separated out and sent to a drier, biomass pieces that are not screened out at said first screening stage are processed at the first one of the sizing stages by a green hammer mill, the biomass pieces exiting the first sizing stage are subjected to a second screening stage and pieces that are sufficiently small are separated and sent to the drier and larger pieces are subjected to a second one of the sizing stages and are then sent to the drier.

2. A method according to claim 1, wherein the sizing stage comprises processing the biomass pieces by one or more of hammering, cutting, chopping and grinding.

3. A method according to claim 1, wherein the drying stage comprises reducing the moisture content of the biomass from as high as 120% in dry basis to as low as 3% in dry basis, or to a percentage in between.

4. A method according to claim 1, wherein the drying stage comprises exposing the biomass to gas flow.

5. A method according to claim 1, wherein the drying stage comprises moving the biomass on a conveyor.

6. A method according to claim 1, wherein the method comprises converting the sized, and then dried, biomass into pellets by pressing the biomass through a pelletizing die.

7. An apparatus for the production of biomass pellets, the apparatus comprising a sizing part, for reducing the average size of biomass pieces, a drying part, for drying the biomass, and a pelletizing part for compressing the biomass to form pellets, wherein, the apparatus is arranged so that after the drying stage, there is no further active reduction in the average size of the biomass pieces, wherein the sizing part comprises two distinct sizing stages, and prior to a first one of the sizing stages, biomass is introduced to a first screening stage where sand and other non-biomass particulates are removed, pieces of biomass that are already sufficiently small to be dried are also separated out and sent to the drying part, biomass pieces that are not screened out at said first screening stage are processed at the first one of the sizing stages by a green hammer mill, the biomass pieces exiting the first one of the sizing stages are subjected to a second screening stage and pieces that are sufficiently small are separated and sent to the drying part and larger pieces are subjected to a second one of the sizing stages and are then sent to the drying part.

8. Apparatus according to claim 7, wherein the sizing part comprises one or more of a hammer, a cutter, a chopper and a grinder.

9. Apparatus according to claim 7, wherein the drying part is arranged to reduce the moisture content of the biomass from as high as 120% in dry basis to as low as 3% in dry basis, or to a percentage in between.

10. Apparatus according to claim 7, wherein the drying part is arranged in use to expose the biomass to gas flow and the drying part comprises a conveyor.

11. Apparatus according to claim 7, wherein the pelletizing part comprises a pelletizing die.

* * * * *